United States Patent [19]

Yonemitsu

[11] 4,181,171

[45] Jan. 1, 1980

[54] MOLDING SAND FEEDING DEVICE

[75] Inventor: Mikio Yonemitsu, Kumagaya, Japan

[73] Assignee: Hitachi Metals, Ltd., Japan

[21] Appl. No.: 908,249

[22] Filed: May 22, 1978

[51] Int. Cl.[2] ..... B22C 15/00

[52] U.S. Cl. ..... 164/193; 141/286; 164/412; 414/293

[58] Field of Search ..... 164/192, 193, 194, 412; 214/17 C; 222/564; 141/286

[56] References Cited

U.S. PATENT DOCUMENTS

| | | | |
|---|---|---|---|
| 1,573,346 | 2/1926 | Kissam | 164/193 X |
| 3,081,009 | 3/1963 | Cooper | 222/564 X |
| 3,601,161 | 8/1971 | Buhrer et al. | 164/193 X |

FOREIGN PATENT DOCUMENTS 42-22899 11/1967 Japan.

*Primary Examiner*—Robert D. Baldwin
*Attorney, Agent, or Firm*—Craig and Antonelli

[57] ABSTRACT

A molding sand feeding device including a first molding sand distribution mechanism constructed of a plurality of partition and bottom or end plates so as to define a plurality of molding sand distribution passages which are in parallel with each other and are inclined downward at angles to the vertical and alternately in the opposite directions, a second molding sand distribution mechanism disposed immediately below the first sand molding distribution mechanism and comprised of a pair of distribution plates assembled in the form of an inverted V so that the molding sand discharged from the first distribution mechanism may be distributed into two flows in opposite directions, and a third molding sand distribution mechanism which is substantially similar in construction to the second distribution mechanism and which is disposed at right angles to the second mechanism so that the molding sand discharged from the second distribution mechanism may be distributed into two flows in opposite directions. A hopper having a capacity equal to one flask of molding sand of a molding flask is interposed between the molding sand feeding device and the molding flask so that molding sand may be prevented from being spilled from the molding flask.

3 Claims, 1 Drawing Figure

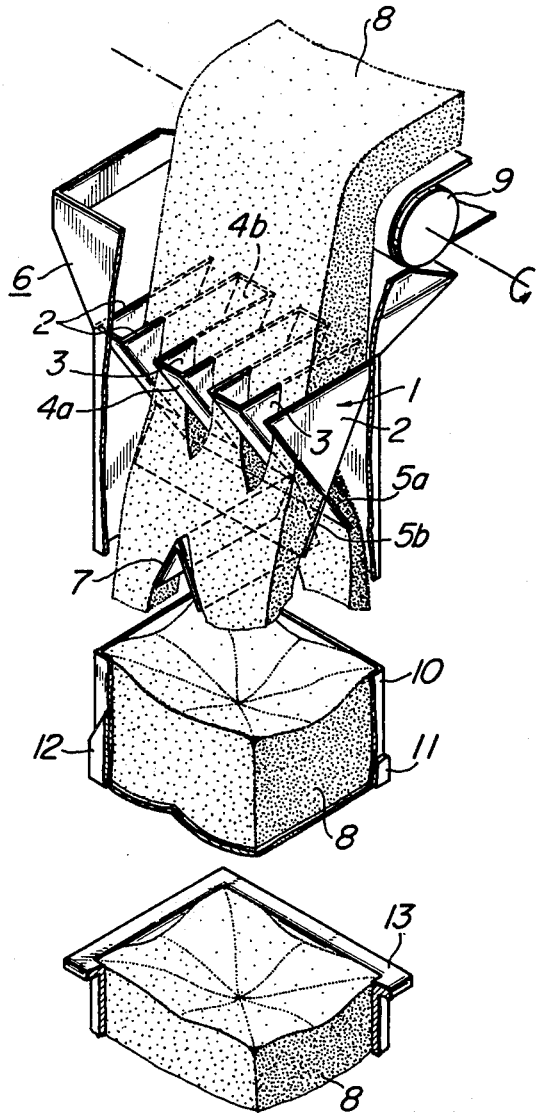
8
9
4b
6
2
3
4a
1
2
3
5a
5b
7
10
12
11
8
13
8

MOLDING SAND FEEDING DEVICE

BACKGROUND OF THE INVENTION

The present invention relates to a molding sand feeding device for use with a molding machine.

In sand molding, the molding sand is in general directly thrown into a molding flask through a chute from a feed device such as a belt feeder. Alternatively, the molding sand is charged into and stored temporarily in a hopper and then filled into a flask. The molding sand thus thrown into the molding flask tends to assume a cone of pile. That is, the molding sand is highest at the center of the molding flask and is gradually sloped toward the upper side edges of the molding flask. Furthermore, since a core or the like is placed at the center portion of the molding flask, the molding sand tends to assume a higher cone. Therefore when the molding sand is subjected to squeezing with the use of a flat squeezing board or plate, the hardness of the mold is gradually decreased from the center of the molding flask toward the upper side edges thereof. That is, the uniform hardness distribution of the mold may not be attained.

In order to avoid such lack of uniformity of the hardness distribution of the mold, the sand surface is smoothed or the molding sand is so distributed that the sand is less at the center than the peripheral portions and that the surface condition of the molding sand thus distributed is substantially symmetrical about the center of the molding flask. So far the excess molding sand has been struck off and smoothed manually or with a use of a device which is actuated by the motion of the squeeze head.

However, the manual operation is undesirable in view of savings in man-hours while the above mechanization is disadvantageous in that an excess amount of the molding sand is fed into the molding flask so that the excess molding sand must be struck off, whereby a considerable amount of molding sand is wasted. Moreover, the handling of the molding sand must be increased so that the feed system such as a conveyor and the like must be increased in size. Furthermore the removed molding sand is scattered so that the working conditions are adversely affected and scoring and wear of sliding parts of machines and devices result.

In order to attain a desired degree of ramming, a squeezing machine with split-type squeeze head has been employed, but it is complex in construction and very expensive. Furthermore the flow condition of the molding sand from a belt feeder or the like to a molding flask is changed from time to time depending upon the properties of the molding sand used, the amount of molding sand in a hopper, the velocity of the belt of the belt feeder (especially when it is started or stopped), the position of a pulley and so on. Therefore even with a chute having an inverted V shape cross section so as to distribute the molding sand into two flows, the molding sand may not be uniformly distributed in a molding flask so that the molding sand is excessively accumulated on one side.

SUMMARY OF THE INVENTION

One of the objects of the present invention is therefore to provide a molding sand feeding device which is very simple in construction, which requires no power at all and which may feed the molding sand into a molding flask in such a way that the surface of the molding sand may be gradually sloped downward toward the center from the upper sides of the molding flask and that the surface condition of the molding sand may be substantially symmetrical about the center of the molding flask, whereby the uniform hardness distribution of the mold may be attained.

Another object of the present invention is to provide a molding sand feeding device which may positively avoid the spill of the molding sand from the molding flask when the molding sand is fed into it.

To the above and other ends, briefly stated, the present invention provides a molding sand feeding device comprising a first molding sand distribution mechanism for distributing the molding sand charged from a molding sand feed device such as a belt feeder into a plurality of downwardly inclined flows which are parallel with each other and are alternately directed in the opposite directions, a second inverted V-shape molding sand distribution mechanism disposed immediately below the first molding sand distribution mechanism for distributing the molding sand discharged from the first molding sand distribution mechanism into two flows in opposite directions, a third molding sand distribution mechanism which is substantially similar in construction to the second molding sand distribution mechanism and which is disposed immediately below the second molding sand distribution means at right angles thereto for diverting the molding sand discharged therefrom into two flows in opposite directions, and a hopper whose bottom is capable of opening and closing and which is disposed below the third molding sand distribution mechanism.

BRIEF DESCRIPTION OF THE DRAWING

Single FIGURE is a perspective view of one preferred embodiment of a molding sand feeding device in accordance with the present invention.

DESCRIPTION OF THE PREFERRED EMBODIMENT

Referring to the single FIGURE, a molding sand feeding device in accordance with the present invention has an upper chute generally designated by the reference numeral 1 which includes a first molding sand distribution mechanism comprising a plurality of parallel partition plates or walls 2 spaced apart by a suitable distance from each other and downwardly inclined bottom or end plates **4*a* and 4*b* attached to the partition plates 2 in such a way that the bottom or end plates 4*a* and 4*b* are alternately directed in the opposite directions. Therefore the molding sand 8 which flows through molding sand distribution passages 3 defined by the partition plates 2 and the bottom or end plates 4*a* and 4*b*** may be alternately distributed in the opposite directions.

Disposed immediately below the discharge end of the first molding sand distribution mechanism (2, **4*a* and 4*b*) is a second molding sand distribution mechanism comprising a pair of distribution plates 5*a* and 5*b* attached to a main chute body 6 in the form of an inverted V so that the molding sand discharged out of the first distribution mechanism (2, 4*a* and 4*b***) may be divided into two flows.

Disposed at the lower portion of the main chute body 6 is a third molding sand distribution mechanism which is at right angles with respect to the second distribution mechanism (**5*a* and 5*b*) and which comprises a pair of distribution plates 7 attached to the main chute body 6** in the form of an inverted V. It should be noted that the third distribution mechanism (7) is adjustable in such a way that the angle between the pair of partition plates 7 may be arbitrarily varied as will be described in detail hereinafter.

Next the mode of operation of the molding sand feeding device with the above construction will be described. When the molding sand in a quantity required for filling one molding flask 13 is charged into the upper chute 1 from a belt feeder 9, the charged molding sand 8 is divided into a plurality of flows alternately directed in the opposite directions by the first distribution mechanism consisting of the partition walls 2 and the bottom or end plates 4*a* and 4*b*. The distribution of the molding sand 8 into a plurality of distribution passages 3 may be positively effected regardless of the variation in flow of the molding sand 8 from the belt feeder 9 due to the start and stop of the belt feeder 9, the flowability of the molding sand 8 and so on.

The molding sand 8 discharged from the first distribution mechanism (2, 4*a* and 4*b*) flows over the inverted V-shaped second distribution mechanism (5*a* and 5*b*) into two directions. The flows of the molding sand 8 discharged out of the second distribution mechanism are further divided into two by the third distribution mechanism (7) in the directions at right angles to the flows of the molding sand 8 divided by the second distribution mechanism (5*a* and 5*b*). After having passed the third distribution mechanism (7), the molding sand is fed into a hopper 10. That is, the charged molding sand 8 is first distributed by the first and second distribution mechanisms into two directions and then redistributed by the third distribution mechanism (7) into two directions. As a consequence, before being filled into the hopper 10, the molding sand 8 is distributed in four directions. When the molding sand 8 is discharged output of the main chute body 6, its flow passes through corner portions of the main chute body 6 and its vicinity. Therefore the molding sand 8 may rest in the hopper 10 with stabilized angles of repose. When mechanized hopper gates 11 and 12 of the hopper 10 are opened, the molding sand is thrown into the molding flask 13 immediately below in such a way that the molding sand 8 is gradually declined from the upper side edges of the molding flask 13 toward the center thereof and the surface condition of the molding sand 8 is substantially symmetrical about the center of the molding flask 13 as shown.

Since the molding sand 8 is temporarily stored in the hopper 10 capable of holding one flask of the molding sand 8 before the molding sand 8 is fed into the molding flask 13, the molding sand 8 may be positively prevented from being scattered as compared to the case of directly feeding the molding sand 8 from the main chute body 6 into the molding flask 13. As a result, the spill of the molding sand from the molding flask may be positively avoided. The hopper 10 may be mounted below the main chute body 6 or on a molding machine. Of course, it is possible to feed the molding sand directly into the molding flask 13 from the main chute body 6 when the molding sand is not necessary to store the hopper 10, temporarily.

As described above, according to the present invention, the molding sand is fed into the molding flask in such a way that the molding sand is gradually inclined inwardly toward the center from the upper side edges of the molding flask and the surface condition of the molding sand is substantially symmetrical about the center of the molding flask so that a uniform hardness distribution of a mold may be obtained with the use of a flat squeeze board or plate and consequently high quality casts may be produced. Furthermore the eccentric distribution of the molding sand due to the variation in charging conditions of molding sand from the belt feeder to the main chute body 6 may be completely eliminated so that the remedy of the surface condition of the molding sand in the molding flask may be not needed. Further advantages are that no special power is required for the distribution of the molding sand and that, the distribution mechanisms are very simple in construction, inexpensive to manufacture and completely free from failures.

The distribution of the molding sand in the molding flask 13 may be arbitrarily selected by suitable combinations of the angles and lengths of the inverted V-shaped second and third distribution mechanisms (5*a* and 5*b*, and 7). Arrangements for varying the angles and positions of the second and third molding sand distribution mechanisms are apparent to those skilled in the art so that no further description shall be made in this specification. Furthermore the distribution plates 5*a*, 5*b* and 7 may be formed with a plurality of holes, grooves, ridges and so on and their edges may be suitably curved or bent in various forms.

What is claimed is:

1. A molding sand feeding device comprising:

(a) a first molding sand distribution mechanism constructed of a plurality of partition and bottom plates for distributing the molding sand downwardly into a plurality of flows alternately directed in opposite directions, (b) a second molding sand distribution mechanism which is disposed immediately below said first molding sand distribution mechanism and which is in the form of an inverted V, whereby the flows of the molding sand discharged from said first molding sand distribution mechanism may be divided into two downward flows in opposite directions, and (c) a third molding sand distribution mechanism which is disposed immediately below said second molding sand distribution mechanism at right angles thereto and which is in the form of an inverted V, whereby the flows of the molding sand discharged from said second molding sand distribution mechanism may be divided into two downward flows in opposite directions.

2. A molding sand feeding device as set forth in claim 1 wherein a pair of distribution plates of said second molding sand distribution mechanism are formed integral with said bottom plates of said first molding sand distribution mechanism.

3. A molding sand feeding device as set forth in claim 1 wherein a hopper whose bottom may be opened downward and which has a capacity capable of holding a flask of molding sand of a molding flask is disposed between said third molding sand distribution mechanism and a molding flask.

* * * * *